US012606349B2

(12) United States Patent
Wang

(10) Patent No.: US 12,606,349 B2
(45) Date of Patent: Apr. 21, 2026

(54) SMELL PROOF CHILD RESISTANT LOCK BAG

(71) Applicant: GUANG DONG ASUWANT PACKAGING CO., LTD, Jiangmen (CN)

(72) Inventor: Peng Wang, Jiangmen (CN)

( * ) Notice: Subject to any disclaimer, the term of this patent is extended or adjusted under 35 U.S.C. 154(b) by 91 days.

(21) Appl. No.: 18/593,774

(22) Filed: Mar. 1, 2024

(65) Prior Publication Data

US 2024/0199281 A1 Jun. 20, 2024

(30) Foreign Application Priority Data

Dec. 29, 2023 (CN) ..... 202311847155.4

(51) Int. Cl.
*B65D 33/25* (2006.01)

(52) U.S. Cl.
CPC ..... *B65D 33/2589* (2020.05); *B65D 33/2584* (2020.05); *B65D 2215/02* (2013.01)

(58) Field of Classification Search
CPC ..... B65D 33/2589; B65D 33/2584; B65D 2215/02; B65D 33/2508; B65D 33/259; B65D 33/2541; A44B 19/30; A44B 19/301; A44B 19/303; A44B 19/305; A44B 19/16; A44B 11/25; A44B 11/2542; A44B 11/2526; A44B 11/2507; A44B 11/2511; A44B 11/266; Y10T 24/158; Y10T 24/2511; Y10T 24/2566; Y10T 70/5035; Y10T 70/5053; A41F 1/006
See application file for complete search history.

(56) References Cited

U.S. PATENT DOCUMENTS

| | | | | |
|---|---|---|---|---|
| 6,233,793 | B1 * | 5/2001 | Wanzenbock | A41F 1/006 24/615 |
| 2017/0099896 | A1 * | 4/2017 | Rapp | A44B 19/30 |
| 2018/0037372 | A1 * | 2/2018 | Tan | B65D 33/2589 |
| 2019/0241322 | A1 * | 8/2019 | Blomberg | B65D 50/04 |

* cited by examiner

*Primary Examiner* — Jack W Lavinder

(57) ABSTRACT

A lock includes: a base, an accommodating slot arranged on the base, and a movable plate fitted in the accommodating slot; wherein at least one deformation block, which is configured to be jammed into the accommodating slot, is set on the movable plate; at least one restriction block, which is configured to be locked in the accommodating slot, is set on the movable plate; a lever plate is provided on the base, which is configured to release the deformation block and thus releasing the movable plate; the lever plate comprises a working part, a connecting part and a pressing part, wherein the connecting part is pivotally coupled to the base. The accommodating slot on an external side of the base is used to lock the movable plate, and the lock can be opened only by pressing the pressing part.

8 Claims, 7 Drawing Sheets

SMELL PROOF CHILD RESISTANT LOCK BAG

CROSS REFERENCE OF RELATED APPLICATION

The present invention claims priority under 35 U.S.C. 119(a-d) to CN 202311847155.4, filed Dec. 29, 2023.

BACKGROUND OF THE PRESENT INVENTION

Field of Invention

The present invention relates to a lock and a bag, and more particularly to a smell proof child resistant lock bag.

Description of Related Arts

Zipper bag is a common tool in life, used to store a variety of items, but these zipper bags generally do not have a locking mechanism. Children always like to open the zipper bag due to curiosity, resulting in the loss of objects in the zipper bag. Generally, in order to prevent children from opening the bag, a lock will be set on the zipper, wherein the lock is used to restrict the slider of the zipper, so as to prevent the children from opening the bag. However, conventional locks are complex, and not durable.

Chinese patent application CN201410523997.9 disclosed a safety lock for a zipper bag, comprising a first zipper block and a second zipper block, wherein the first zipper block is provided with a locking rod while the second zipper block is provided with a locking frame; the locking rod can be inserted into the locking frame to connect the first zipper block and the second zipper block; the second zipper block is also provided with a disengagement device capable of separating the locking rod from the locking frame, and a split slot is formed between the disengagement device and the top surface of the second zipper block. Such disclosure refers to a latch, but such a latch will be easily inadmissible during use, resulting in broken or misplaced pieces, which affects the subsequent use of the latch.

SUMMARY OF THE PRESENT INVENTION

An object of the present invention is to solve a technical problem that in the process of preventing a zipper bag from being opened easily, a lock designed to be used can be easily broken or misplaced, and is difficult to use.

Accordingly, in order to accomplish the above object, the present invention provides:

- a lock, comprising: a base, an accommodating slot arranged on the base, and a movable plate fitted in the accommodating slot; wherein at least one deformation block, which is configured to be jammed into the accommodating slot, is set on the movable plate; at least one restriction block, which is configured to be locked in the accommodating slot, is set on the movable plate; a lever plate is provided on the base, which is configured to release the deformation block and thus releasing the movable plate; the lever plate comprises a working part, a connecting part and a pressing part, wherein the connecting part is pivotally coupled to the base.

Preferably, the lever plate and the base are integrally molded, and the connecting part between two sides of the lever plate and the base is deformable. The integrally molded lever plate and base make it difficult to discover the opening method from the appearance, providing a child resistant function.

Preferably, a lever is provided at the working part for jacking up the movable plate. The lever enables the working part to cock up the movable plate more smoothly, which is convenient for the user.

Preferably, the deformation block is provided on both sides at one end of the movable plate; the base is provided with a clip corresponding to the deformation block, and the deformation block is stuck into the clip of the base after being pressed into the accommodating slot; by pressing a pressing part of the lever plate, the working part is lifted up, in such a manner that the movable plate is lifted up by the lever to release the deformation block. The deformation block is clamped together with the base, and the movable plate can be cocked up by using the lever plate to release the deformation block, so as to make the entire device more stable and reliable for use.

Preferably, the deformation block is located at one end of the movable plate, and is corresponding to the working part of the lever plate; a clip is correspondingly provided on the working part, and the deformation block is stuck into the clip of the working part after being pressed into the accommodating slot; by pressing a pressing part of the lever plate, the working part is lifted up, thereby lifting the clip to release the deformation block. The deformation block is clamped together with the working part, and the working part can be lifted to release the deformation block, thereby opening the movable plate.

Preferably, a lever for jacking up the movable plate is provided on the working part, so as to assist in releasing the deformation block. The lever enables the deformation block to be separated from the working part faster and smoother, making the device more convenient to use.

Preferably, at least one flat spring is provided at a bottom of the accommodating slot, the flat spring is configured to contact with an internal surface of the movable plate. The spring plate can pop open the movable plate, thus facilitating the user to take off the movable plate, and making the device more convenient and reliable for use.

Preferably, the movable plate has a cavity, a socket is provided on one side the cavity, and a wedge-shaped elastic block is arranged inside the cavity. The wedge-shaped elastic block is utilized to connect a slider of a zipper, thereby facilitating the connection of the device with the zipper.

Preferably, a clipping plate is provided on a bottom side of the base; at least one bolt is provided on the base, and a blind hole is provided on the clipping plate for cooperating with the bolt. The clipping plate enables easy mounting of the device on an object that needs to be used, and facilitates the implementation of the device.

The present invention also provides a smell proof child resistant lock bag, comprising: a bag body having a strip-shaped opening, and a zipper installed on the strip-shaped opening, wherein one end of the zipper is fitted with the lock as mentioned above; a slider on the zipper is capable of being jammed with the wedge-shaped elastic block through the socket.

Preferably, a patch is arranged on the bag body and covers the strip-shaped opening, and at least one pair of strip-shaped snap fasteners is correspondingly provided on one end of the patch and an internal surface of the bag body.

Preferably, one end of the patch, which is away from the strip-shaped snap fasteners, is adhered to the internal surface of the bag body by heat pressing.

The present invention has the following beneficial effects:

I. The present invention arranges the accommodating slot on an external side of the base to lock the movable plate, so that the movable plate can be mounted on the base only in a specific manner. At the same time, for removing the movable plate, the lock can be opened only by pressing the pressing part, which provides a certain protective effect.

II. The present invention makes the lever plate and the base integrally molded, which not only makes the appearance more beautiful, but also provides a certain degree of concealment to the pressing part. It is difficult to find out the opening method from the appearance, providing the child resistant function.

III. The present invention connects the movable plate to the zipper slider, and installs the lock on the bag body, which can prevent children from opening the bag body and thus reducing the safety risk.

IV. The present invention utilizes the clipping plate to facilitate the installation of the lock on the bag body, so that the device can be adapted to different bags, enhancing the application range.

BRIEF DESCRIPTION OF THE DRAWINGS

In order to illustrate the technical solutions in embodiments of the present invention or prior art more clearly, the accompanying drawings to be used in the description of the embodiments or prior art will be briefly introduced below. It is obvious that the accompanying drawings described below are only some of the embodiments of the present invention, and that other drawings can be obtained according to the structures illustrated in the drawings by a person of ordinary skill in the field, without creative works.

DETAILED DESCRIPTION OF THE PREFERRED EMBODIMENT

To facilitate understanding, the present invention will be described below in conjunction with embodiments and accompanying drawings.

It should be noted that all directional indications in the embodiments of the present invention are only used to explain the relative positional relationship, movement, etc., between the components in a particular attitude, and that the directional indications change accordingly if that particular attitude is changed.

Furthermore, descriptions such as "first", "second", etc. in the present invention are used for descriptive purposes only and are not to be construed as indicating or implying their relative importance or implicitly specifying the number of technical features indicated. Thus, a feature defined as "first" or "second" may include at least one such feature, either explicitly or implicitly. In the description of the present invention, "plurality" means at least two, e.g., two, three, etc., unless otherwise expressly and specifically limited.

In the present invention, unless otherwise expressly specified and limited, the terms "connect", "mount", etc. are to be understood in a broad sense, e.g. "mount" can be a fixed connection, a removable connection or an integrated connection; it can be a mechanical connection or an electrical connection; it can be a direct connection or an indirect connection through an intermediate medium; it can be a connection within two elements or an interaction between two elements. For those of ordinary skill in the art, the specific meanings of the above terms in the present invention may be understood on a case-by-case basis.

Figure 1:
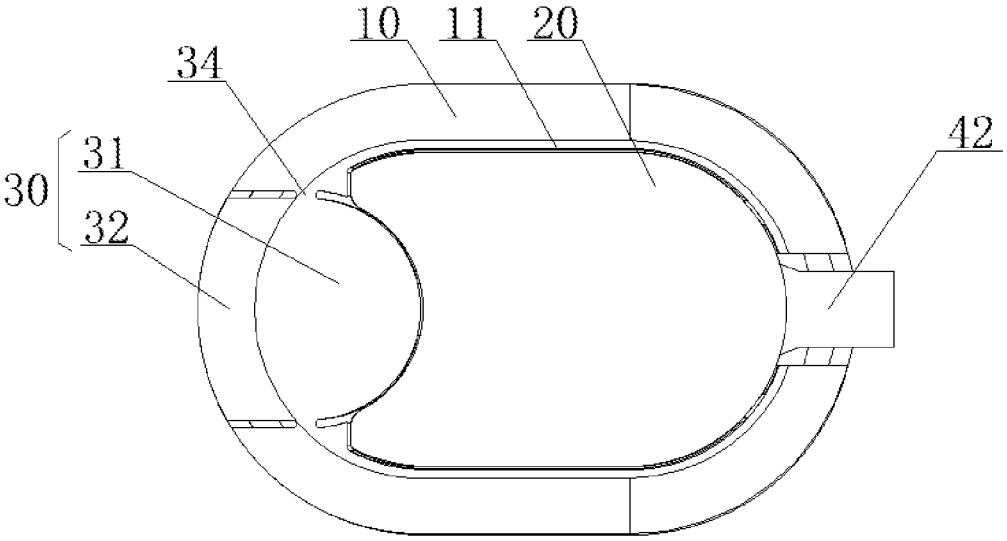
FIG. 1 is a structural view of an embodiment according to the present invention.
Figure 4:
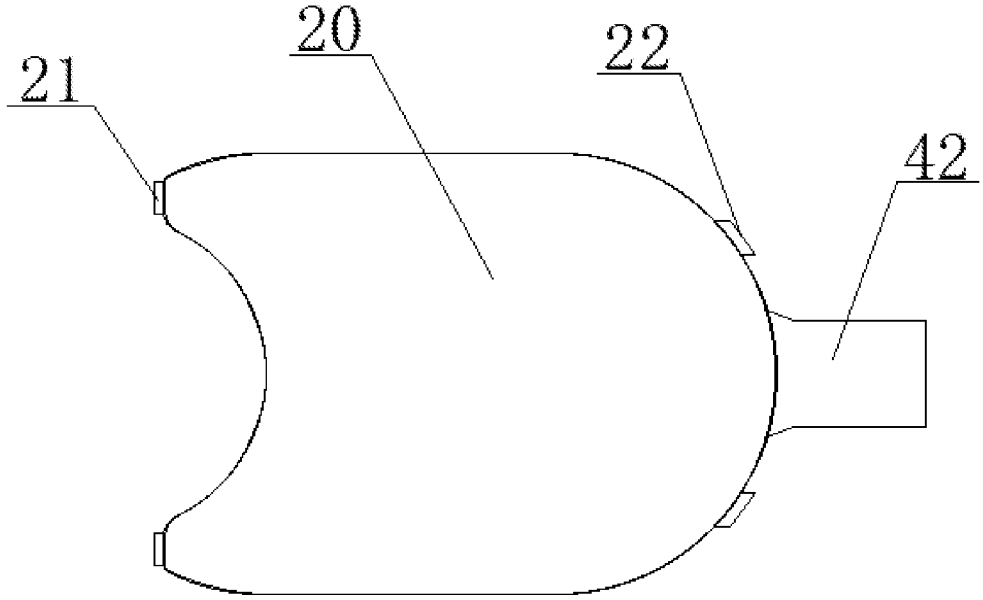
FIG. 4 is a structural view of a movable plate according to the embodiment.

The present invention provides a lock, as shown in FIGS. 1 and 4 comprising: a base 10, an accommodating slot 11 arranged on the base 10, and a movable plate 20 fitted in the accommodating slot 11; wherein when the movable plate 20 is placed into the accommodating slot 11, the lock is under a locking state; at least one deformation block 21 is set on the movable plate 20, and at least one restriction block 22 is set on the other side of the movable plate 20. Specifically, to put the movable plate 20 into the accommodating slot 11, one end of the movable plate 20, which is installed with the restriction block 22, should be firstly inserted into the accommodating slot 11; and then the other end of the movable plate 20 should be pressed, so that the deformation block 21 is stuck into the accommodating slot 11, and a locking process is accomplished. Since the movable plate 20 has nowhere to apply a force, it is impossible to take out the movable plate 21 from the accommodating slot 11 from the outside.

Figure 2:
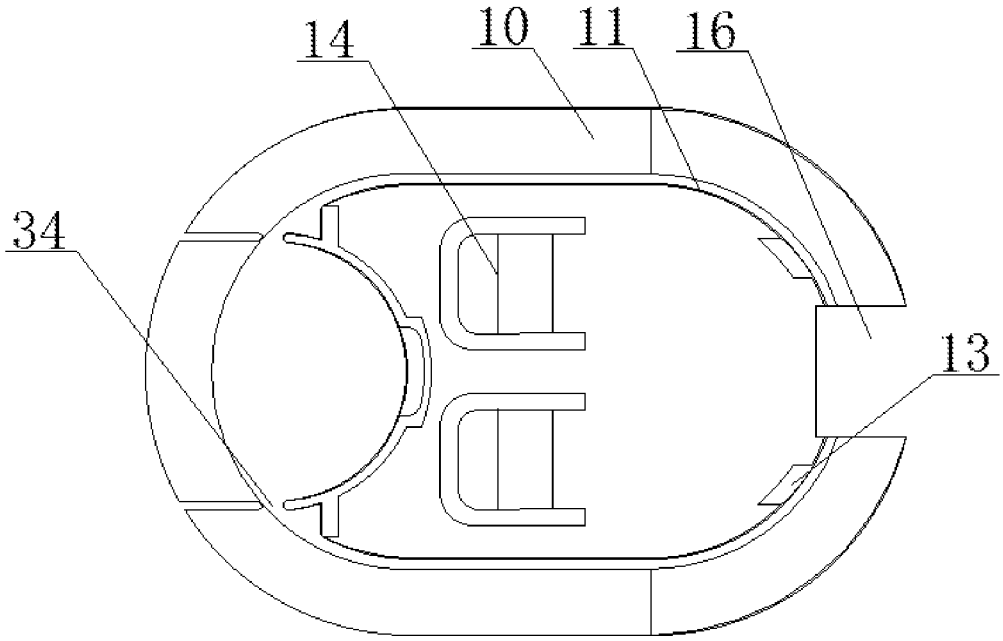
FIG. 2 is a structural view of a base according to the embodiment.

To remove the movable plate 20 from the accommodating slot 11, as shown in FIGS. 1 and 2, a lever plate 30 is provided on the base 10, which is configured to release the deformation block 21 and thus releasing the movable plate 20. The lever plate 30 comprises a working part 31 and a pressing part 32. By pressing the pressing part 32, the working part 31 is lifted up, so as to move the end of the movable plate 20 out of the accommodating slot 11, thus removing the movable plate 20. To remove the movable plate 20 smoother, a lever is provided at the working part 31, which extends towards the movable plate 20 and contacts an internal surface of the movable plate 20. When the working part 31 is jacked up, the lever pushes the end of the movable plate 20 outwardly, so as to remove the end of the movable plate 20 from the accommodating slot 11.

In order to make the structure more beautiful and production more convenient, a deformable connecting part 34 is provided at two sides of a joint of the lever plate (30) and the base (10), wherein the base 10, the lever plate 30 and the connecting part 34 are integrally molded. When pressing the pressing part 32, the connecting part 34 serves as the point of rotation, wherein the connecting part 34 deforms, the pressing part 32 moves downwards, and the working part 31 moves upwards. By integrally molding the base 10, the lever plate 30 and the connecting part 34, it is difficult to find out through external observation that the movable plate 20 can be removed by squeezing the pressing part 32, which provides the child resistant function.

Meanwhile, according to the embodiment, the connecting part 34 may be a pivot shaft, so as to provide a rotational connection between the lever plate 30 and the base 10. With such structure, the working part 31 can still be jacked up by pressing the pressing part 32, so as to release the deformation block 21.

Figure 3:
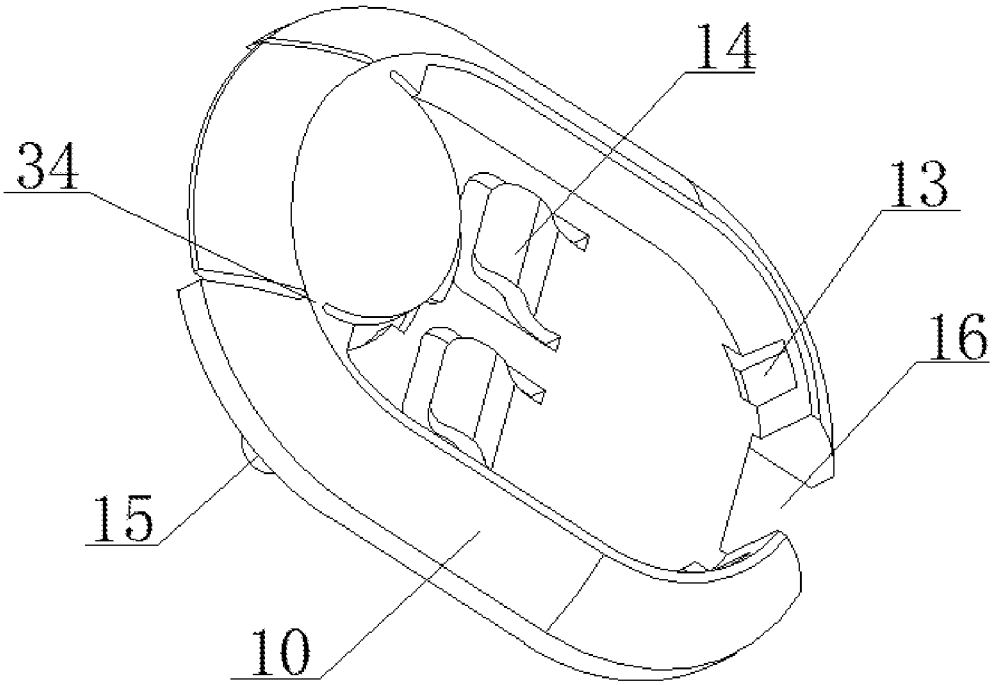
FIG. 3 is a sketch view of an internal structure of the base according to the embodiment.

Referring to FIGS. 2 and 3, multiple flat springs 14 are provided in the accommodating slot 11, and the flat spring 14 acts on the internal surface of the movable plate 20. When the lever lifts one end of the movable plate 20, the elastic force of the flat spring 14 will be applied on the movable plate 20 and popped it up, so as to facilitate the user to take down the movable plate 20.

Figure 6:
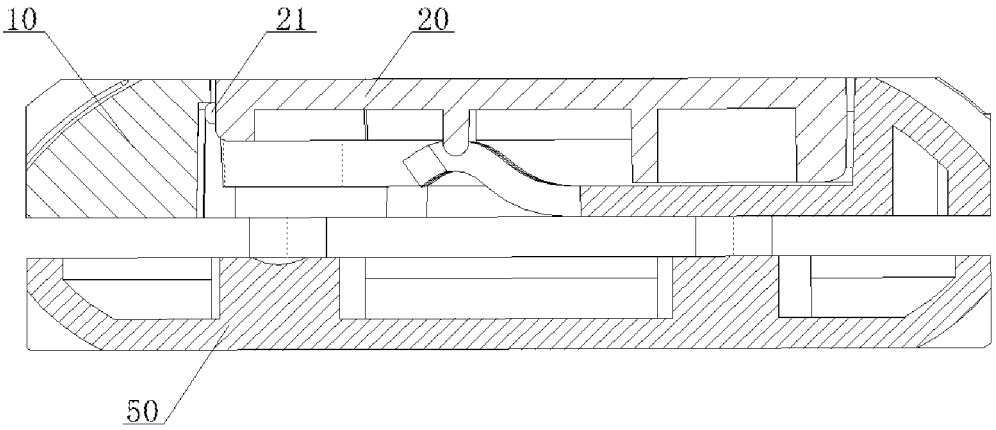
FIG. 6 is a cross-sectional view of the embodiment.

Referring to FIGS. 3 and 6, according to the embodiment, a clip is provided on the accommodating slot 11, which is corresponding to the deformation block 21. A restriction slot 13 is also provided on the accommodating slot 11, which is corresponding to the restriction block 22. To lock the movable plate 20, the restriction block 22 is first inserted into the restriction slot 13, and then the movable plate 20 is pressed to deform the deformation block 21, thereby driving the deformation block 21 into the clip.

Specifically, a cross-section of the deformation block 21 is semi-circular, so when the deformation block 21 is pressed into the accommodating slot 11, an external end of the clip contacts a curved surface of the deformation block 21 and causes it to deform, thus pressing the deformation block 21 into the clip. The restriction block 22 is wedge shaped. When one end of the movable plate 20, which is provided with the restriction block 22, is inserted into the accommodating slot 11, the restriction block 22 accordingly enters the restriction slot 13 and is restricted thereby. At this time, the end of the restriction block 22 cannot be pulled out of the movable plate 20 because the restriction block 22 is restricted by the restriction slot 13. To remove the movable plate 20, the end of the movable plate 20, which is provided with the deformable block 21, should be taken out first, and then the movable plate 20 can be withdrawn to separate the restriction block 22 from the restriction slot 13.

Figure 5:
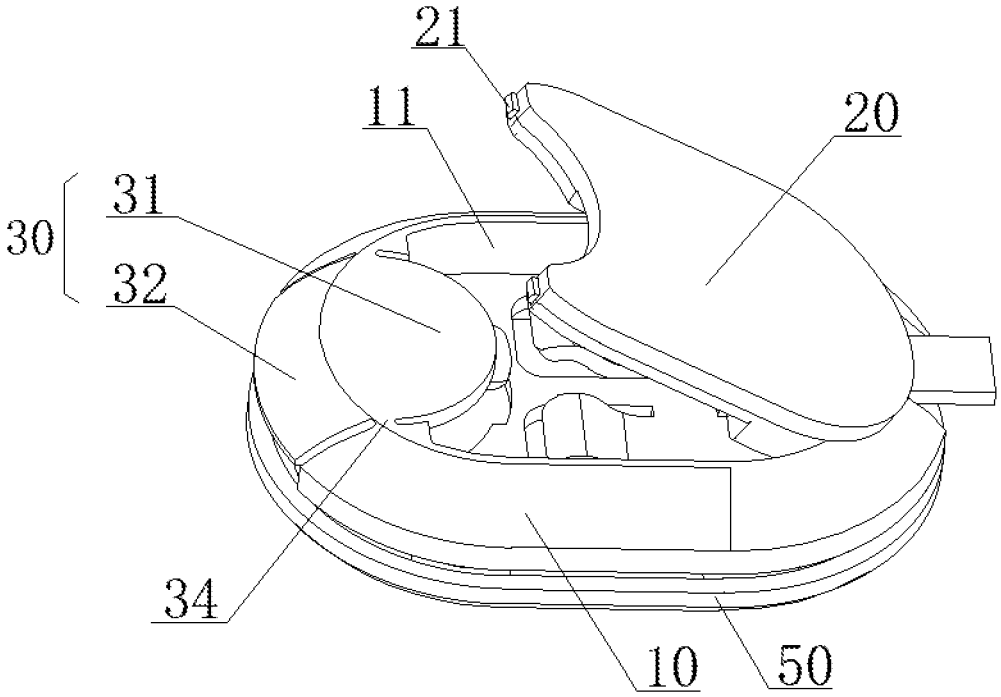
FIG. 5 is a sketch view of a use state according to the embodiment.

Referring to FIG. 5, during use, the restriction block 22 at one end of the movable plate 20 is firstly inserted into the restriction slot 13 of the accommodating slot 11, and then the other end of the movable plate 20 is pressed, so that the deformation block 21 deforms and enters into the clip. At this time, the movable plate 20 contacts and deforms the flat springs 14, and the movable plate 20 is locked. To take out the movable plate 20, the pressing part 32 on the lever plate 30 should be pressed, so that the working part 31 moves upwards and lifts the lever synchronously to contact the end of the movable plate 20. At this time, the deformation block 21 deforms again and moves out from the clip, and then the elastic force of the flat springs 14 is applied on the movable plate 20 to pop it up, so that the user can take out the movable plate 20 more conveniently. Meanwhile, the restriction block 22 also moves out from the restriction slot 13, thereby opening of the lock.

Figure 9:
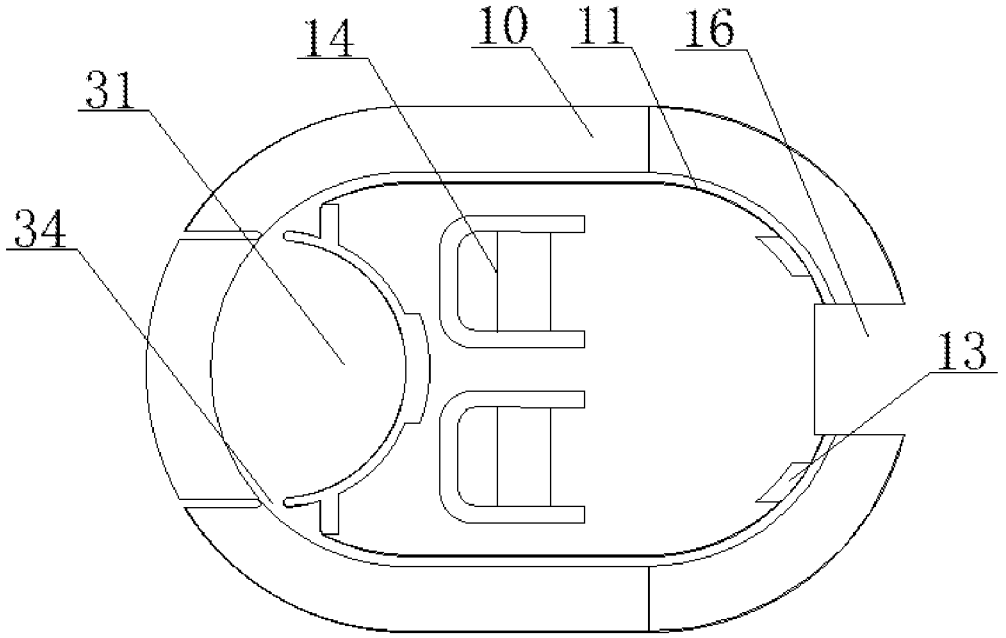
FIG. 9 is a structural view of the base according to another embodiment.
Figure 10:
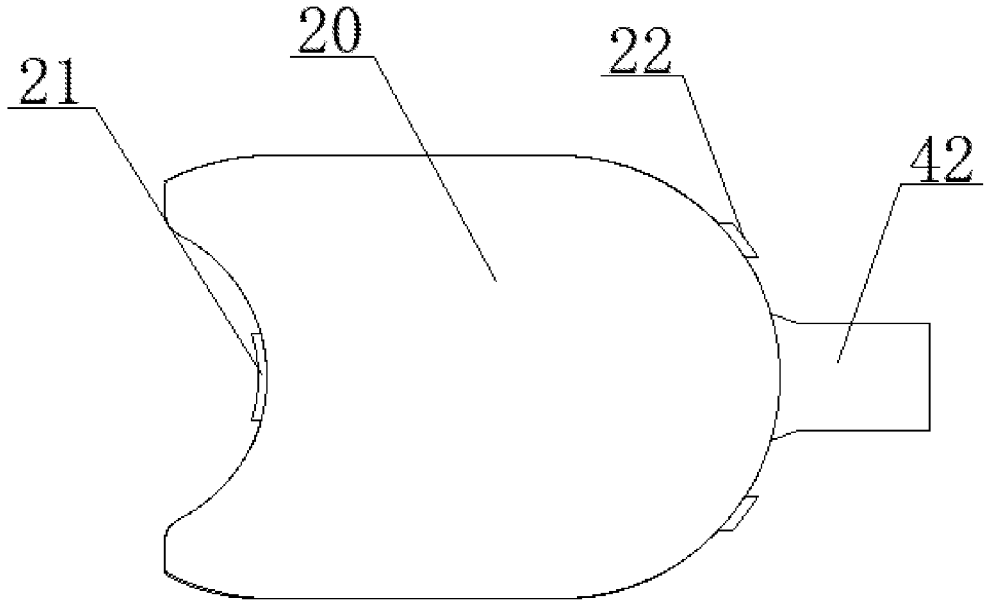
FIG. 10 is a structural view of the movable plate according to the another embodiment.

Referring to FIGS. 9 and 10, correspondingly, the deformation block 21 according to the embodiment may also extend to the internal surface of the work part 31. With such structure, when the end part of the movable plate 20 is pressed, the deformation block 21 contacts the end part of the work part 31, which is deformed thereby and reaches the internal surface of the work part 31; or the work part 31 moves downwards, so that the movable plate 20 can enter the accommodating slot 11. Then the working part 31 springs back to restrict the deformation block 21, which also makes the lock in a locking state. To open the lock, the pressing part 32 should be pressed to jack the working part 31 up. At this time, the flat spring 14 acts on the movable plate 20 and gives a tendency to open. When the working part 31 is cocked at a certain angle, i.e., the working part 31 is rotated around the connecting part 34, the working part 31 will slowly move away from the deformation block 21 until the working part 31 is misaligned with the deformation block 21 and release the deformation block 21. At this time, the end of the movable plate 20 will pop out under the force of the flat spring 14, and the lock will be opened.

Specifically, according to the embodiment, the end of the movable plate 20 may be connected to the working part 31, wherein the deformation block 21 is provided on the movable plate 20 and is corresponding to the working part 31. The deformation block 21 extends to the internal surface of the working part 31. The lever is provided on the working part 31, and the lever extends to the internal surface of the movable plate 20. After pressing the pressing part 32, the pressing part 32 moves downwards, and the working part 31 moves upwards and slowly moves away from the deformation block 21. At the same time, the lever also jacks up the end of the movable plate 20. As a result, the deformation block 21 is deformed and moves out from the end of the working part 31, so that the deformation block 21 can be separated from the working part 31 without undergoing too much deformation, making the opening of the lock more relaxed.

Figure 8:
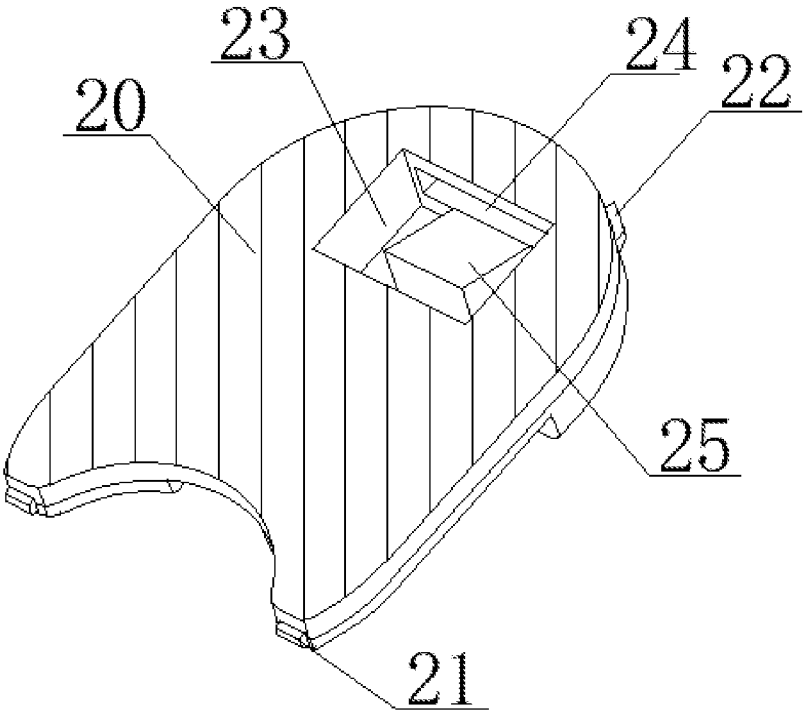
FIG. 8 is a sketch view of an internal structure of the movable plate according to the embodiment.

According to the embodiment, as shown in FIG. 8, the movable plate 20 may be connected to other components. Specifically, the movable plate 20 has a cavity 23, a socket 24 is provided on one side the cavity 23, and a wedge-shaped elastic block 25 is arranged inside the cavity 23. and a notch 16 is provided on the base 10 and is corresponding to the socket 24. The components to be connected are extended into the cavity 23 through the socket 24, and then the elastic block 25 provides a locking function, thereby connecting the movable plate 20 to other components.

Figure 7:
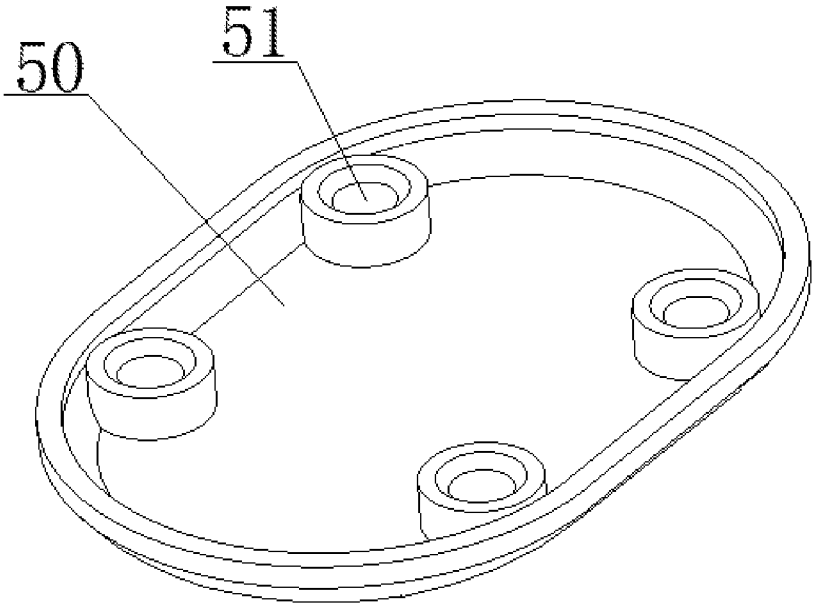
FIG. 7 is a structural view of a clipping plate according to the embodiment.

Specifically, in the embodiment, to mount the lock on a desired component, as shown in FIGS. 3 and 7, a clipping plate 50 is provided on one side of the base 10, at least one bolt 15 is provided on the base 10, and a blind hole 51 is provided on the clipping plate 50 for cooperating with the bolt 15. The lock can be clamped on the desired component through the bolt 15 and the blind hole 51.

Figure 11:
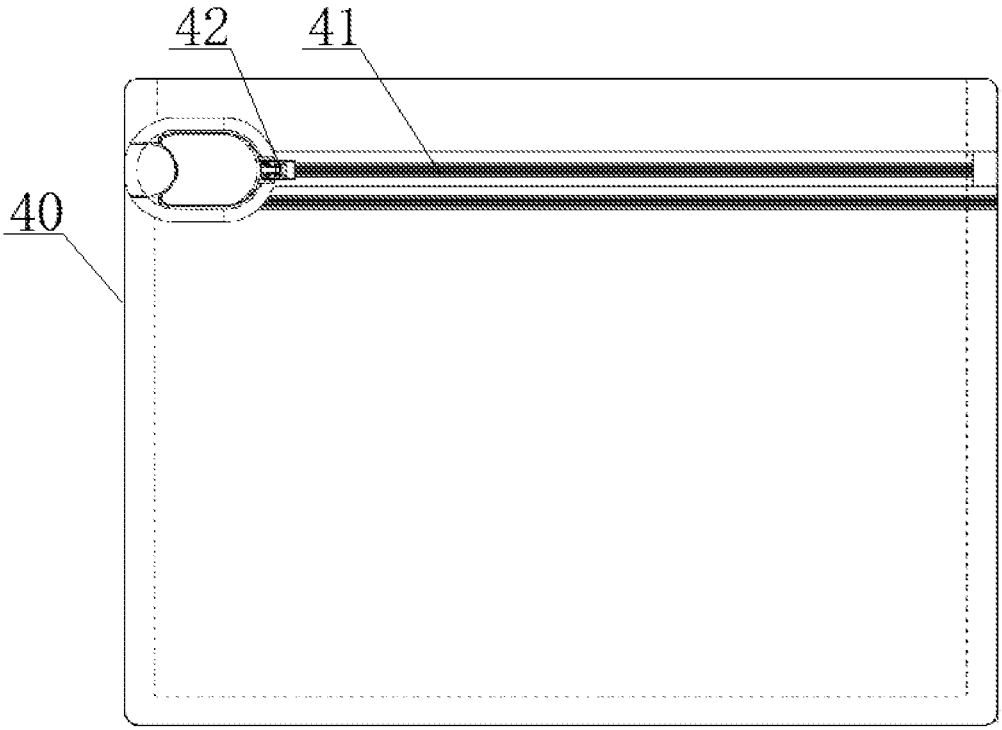
FIG. 11 is a structural view of a bag body according to the embodiment.
Figure 12:
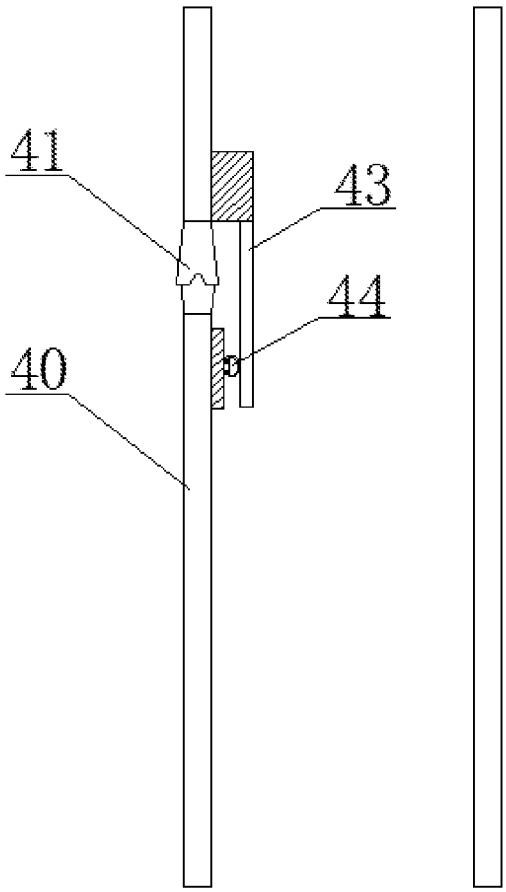
FIG. 12 is a sketch view of an internal structure of the bag body according to the embodiment.

The present invention also provides a smell proof child resistant lock bag, as shown in FIGS. 11 and 12, comprising: a bag body 40 having a strip-shaped opening, and a zipper 41 installed on the strip-shaped opening for sealing, wherein one end of the zipper 41 is fitted with the lock as mentioned above; a slider 42 on the zipper 41 is connected to the end of the movable plate 20 on which the restriction block 22 is provided. The lock is installed at the end where the slider 42 seals the zipper 41, so that when the movable plate 20 is locked on the base 10, the slider 42 cannot be pulled at this time, and the bag body 40 cannot be opened. The zipper 41 can only be pulled open when the movable plate 20 is removed from the base 10.

Specifically, according to the embodiment, during use, the slider 42 is inserted into the socket 24, and the elastic block 25 deforms. The the slider 42 should be further inserted to snap the elastic block 25 is a hole on the slider 42, thereby connecting the movable plate 20 to the slider 42.

Specifically, since the finger-pinched end of the slider 42 has a hole, the elastic block 25 will enter the hole on the slider 42 after the finger-pinched part of the slider 42 is inserted into the socket 24, thus preventing the slider 42 from separating from the movable plate 20.

For installing the lock on the bag, the clipping plate 50 is first placed on one internal end of the zipper 41, then the base 10 is pressed on the clipping plate 50 so that the bolt 15 is inserted into the blind hole 51. The base 10 and the clipping plate 50 are installed on the bag body 40 by clamping back and forth.

Referring to FIG. 12, the bag body 40 is provided with a patch 43 covering the opening, wherein the patch 43 is adhered to an internal side of the bag body 40, and at least one pair of snap fasteners 44 are provided on the patch 43 to connecting the internal side of the bag body 40 for sealing.

It should be understood that the above description of the specific embodiments is only to illustrate the technical routes and features of the present invention, which is intended to enable the person skilled in the art to understand the content of the present invention, and thus implementing it. However, the present invention is not limited to the above specific embodiments. Any changes or modifications made within the scope defined by the following claims shall be covered within the protection scope of the present invention.

What is claimed is:

1. A lock, comprising: a base (10), an accommodating slot (11) arranged on the base (10), and a movable plate (20) fitted in the accommodating slot (11); wherein at least one deformation block (21), which is configured to be jammed into the accommodating slot (11), is set on the movable plate (20); at least one restriction block (22), which is configured to be locked in the accommodating slot (11), is set on the movable plate (20); a lever plate (30) is provided on the base (10), which is configured to release the deformation block (21) and thus releasing the movable plate (20); the lever plate (30) comprises a working part (31), a connecting part (34) and a pressing part (32), wherein the connecting part (34) is pivotally coupled to the base (10);

wherein the deformation block (21) is located at one end of the movable plate (20), and is corresponding to the working part (31) of the lever plate (30); a clip is correspondingly provided adjacent the working part (31), and the deformation block (21) is stuck into the clip of the working part (31) after being pressed into the accommodating slot (11); by pressing the pressing part (32) of the lever plate (30), the working part (31) is lifted up, thereby lifting the one end of the movable plate to release the deformation block (21).

2. The lock, as recited in claim 1, wherein a lever for jacking up the movable plate (20) is provided on the working part (31), so as to assist in releasing the deformation block (21).

3. The lock, as recited in claim 1, wherein at least one flat spring (14) is provided at a bottom of the accommodating slot (11), the flat spring (14) is configured to contact with an internal surface of the movable plate (20).

4. The lock, as recited in claim 1, wherein the movable plate (20) has a cavity (23), a socket (24) is provided on one side the cavity (23), and a wedge-shaped elastic block (25) is arranged inside the cavity (23).

5. A smell proof child resistant lock bag, comprising: a bag body (40) having a strip-shaped opening, and a zipper (41) installed on the strip-shaped opening, wherein one end of the zipper (41) is fitted with the lock as recited in claim 4; a slider (42) on the zipper (41) is capable of being jammed with the wedge-shaped elastic block (25) through the socket (24).

6. The smell proof child resistant lock bag, as recited in claim 5, wherein a patch (43) is arranged on the bag body (40) and covers the strip-shaped opening, and at least one pair of strip-shaped snap fasteners (44) is correspondingly provided on one end of the patch (43) and an internal surface of the bag body (40).

7. The smell proof child resistant lock bag, as recited in claim 5, wherein one end of the patch (43), which is away from the strip-shaped snap fasteners (44), is adhered to the internal surface of the bag body (40) by heat pressing.

8. The lock, as recited in claim 1, wherein a clipping plate (50) is provided on a bottom side of the base (10); at least one bolt (15) is provided on the base (10), and a blind hole (51) is provided on the clipping plate (50) for cooperating with the bolt (15).

* * * * *